US009422820B2

(12) United States Patent
Pieri

(10) Patent No.: US 9,422,820 B2
(45) Date of Patent: Aug. 23, 2016

(54) METHOD AND SYSTEM FOR SELF-LOCKING A CLOSURE BUCKET IN A ROTARY MACHINE

(71) Applicant: Nuovo Pignone SRL, Florence (IT)

(72) Inventor: Marco Pieri, Siena (IT)

(73) Assignee: NUOVO PIGNONE SRL, Florence (IT)

( * ) Notice: Subject to any disclaimer, the term of this patent is extended or adjusted under 35 U.S.C. 154(b) by 657 days.

(21) Appl. No.: 13/886,188

(22) Filed: May 2, 2013

(65) Prior Publication Data

US 2014/0205460 A1 Jul. 24, 2014

(30) Foreign Application Priority Data

Jan. 23, 2013 (IT) ..... CO2013A0002

(51) Int. Cl.
*F01D 5/32* (2006.01)
*F01D 5/30* (2006.01)

(52) U.S. Cl.
CPC ..... *F01D 5/326* (2013.01); *F01D 5/303* (2013.01); *F01D 5/32* (2013.01); *F01D 5/323* (2013.01); *Y10T 29/4932* (2015.01)

(58) Field of Classification Search
CPC ..... F01D 5/32; F01D 5/326; F01D 5/323; F01D 5/303; Y10T 29/4932
See application file for complete search history.

(56) References Cited

U.S. PATENT DOCUMENTS 1,303,004 A 5/1919 Aldis
1,829,881 A 11/1931 Tucker
2,331,555 A 1/1943 Jostich, Jr. et al.
3,088,708 A * 5/1963 Feinberg ..... F01D 5/3038 416/215
6,431,836 B2 8/2002 Zimmermann
7,261,518 B2 * 8/2007 Golinkin ..... F01D 5/3007 416/215

(Continued)

FOREIGN PATENT DOCUMENTS

DE 718014 C 2/1942
DE WO 2010031693 A1 * 3/2010 ..... F01D 5/3038

(Continued)

OTHER PUBLICATIONS

Search Report and Written Opinion from corresponding IT Application No. CO20130002 dated Jul. 3, 2013.

(Continued)

*Primary Examiner* — Richard Edgar
*Assistant Examiner* — Brian P Wolcott
(74) *Attorney, Agent, or Firm* — Fletcher Yoder, P.C.

(57) ABSTRACT

A system includes a turbomachine that includes at least one rotor disk or stage having a peripheral portion disposed about a rotational axis of the rotor disk or stage. The peripheral portion includes a groove that extends circumferentially about the peripheral portion. The groove has a first groove surface and a second surface disposed opposite the first groove surface. The turbomachine also includes a closure bucket disposed adjacent at least one bucket within the groove. The closure bucket has a first surface that interfaces with the first groove surface and a second groove surface disposed opposite the first surface. The closure bucket blocks circumferential movement of the at least one bucket within the groove relative to the rotor disk or stage. The turbomachine further includes a single wedge disposed between and contacting the second surface of the closure bucket and the second groove surface to secure the closure bucket within the groove.

16 Claims, 11 Drawing Sheets

(56) References Cited

U.S. PATENT DOCUMENTS

| | | | |
|---|---|---|---|
| 2009/0290983 | A1 | 11/2009 | Tanaka |
| 2010/0296936 | A1 | 11/2010 | Wilson et al. |

FOREIGN PATENT DOCUMENTS

| | | | |
|---|---|---|---|
| EP | 1134359 | A2 | 9/2001 |
| EP | 2333243 | A2 | 6/2011 |
| GB | 659592 | A | 10/1951 |
| WO | 2010031693 | A1 | 3/2010 |
| WO | 2013102591 | A1 | 7/2013 |

OTHER PUBLICATIONS

PCT Search Report and Written Opinion issued Apr. 15, 2014 in connection with corresponding PCT Patent Application No. PCT/EP2014/051021.

* cited by examiner

METHOD AND SYSTEM FOR SELF-LOCKING A CLOSURE BUCKET IN A ROTARY MACHINE

CROSS-REFERENCE TO RELATED APPLICATION

This application claims priority to and benefit of Italian Patent Application No. CO2013A000002, entitled "METHOD AND SYSTEM FOR SELF-LOCKING A CLOSURE BUCKET IN A ROTARY MACHINE", filed Jan. 23, 2013, which is herein incorporated by reference in its entirety.

BACKGROUND

The subject matter disclosed herein relates to methods and systems for self-locking a closure bucket in rotary machines such as turbomachines.

Turbomachines or rotary systems, such as axial compressors and turbines (e.g., gas turbine axial compressors, steam turbines, etc.), may generally include a rotor portion that rotates about an axis during the operation of the system. For example, in an axial compressor or steam turbine, the rotor portion (e.g., disk of a stage) may include a number of buckets (e.g., rotary blades) disposed about a shaft. The buckets are circumferentially disposed adjacent each other about the rotor portion. Often these buckets are loaded onto the rotor portion in a tangential direction. The last bucket loaded on the rotor portion is called the closure bucket. The closure bucket is secured to the rotor portion to lock the buckets in place on the rotor and to block circumferential movement of the buckets along the rotor portion (i.e., relative to the rotor portion). However, the mechanisms used to secure the closure bucket to the rotor portion may result in stress concentration the rotor and/or significant remachining of the rotor during reassembly of the stage (e.g., turbine stage of a steam turbine or compressor stage).

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a turbomachine. The turbomachine includes at least one rotor wheel that includes a peripheral portion disposed about a rotational axis of the at least one rotor disk or stage. The peripheral portion includes a groove that extends circumferentially about the peripheral portion. The groove has a first groove surface and a second groove surface disposed opposite the first groove surface. The turbomachine also includes at least one bucket disposed within the groove. The turbomachine further includes a closure bucket disposed adjacent the at least one bucket within the groove. The closure bucket has a first surface that interfaces with the first groove surface and a second surface disposed opposite the first surface. The closure bucket blocks circumferential movement of the at least one bucket within the groove relative to the at least one rotor disk or stage. The turbomachine yet further includes a single wedge disposed between and contacting the second surface of the closure bucket and the second groove surface to secure the closure bucket within the groove.

In accordance with a second embodiment, a system includes a bucket locking assembly for securing multiple buckets within a groove of a rotor disk or stage of a turbomachine to block circumferential movement of the multiple buckets relative to the rotor disk or stage. The bucket locking assembly includes a closure bucket configured to be disposed between adjacent buckets within the groove. The closure bucket has a first surface configured to interface with a first groove surface of the groove and a second surface disposed opposite the first surface. The closure bucket is configured to block circumferential movement of the multiple buckets within the groove relative to the rotor disk or stage. The bucket locking assembly also includes a single wedge configured to be disposed between and to contact the second surface of the closure bucket and a second groove surface of the groove to secure the closure bucket within the groove. The single wedge is subject to an axial force on the second surface of the closure bucket to secure the closure bucket within the groove.

In accordance with a third embodiment, a method for securing buckets within a groove of a rotor disk or stage of a turbomachine is provided. The method includes disposing a single wedge into a closure groove portion of the groove, wherein the closure groove portion includes a first groove surface, a second groove surface, and a third groove surface, the single wedge is disposed between the first and second groove surfaces, the first groove surface includes multiple recesses, and the single wedge includes a first wedge surface and a second wedge surface. The method also includes radially inserting a closure bucket having a first surface and a second surface disposed opposite the second surface into the closure groove portion so that the second surface contacts an outer surface of the rotor adjacent the closure groove, wherein the closure bucket includes multiple protrusions that extend from the first surface. The method further includes axially displacing the closure bucket until the first surface contacts the first groove surface, radially displacing the closure bucket until the multiple protrusions align with the multiple recesses of the first groove surface, and axially displacing the closure bucket until the first surface interfaces with the first groove surface and the multiple protrusions insert into the multiple recesses. The method yet further includes radially displacing the single wedge from the third groove surface until the first wedge surface contacts the second surface of the closure bucket and the second wedge surface contacts the second groove surface to secure the closure bucket within the closure groove portion to block circumferential movement of the buckets relative to the rotor disk or stage.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
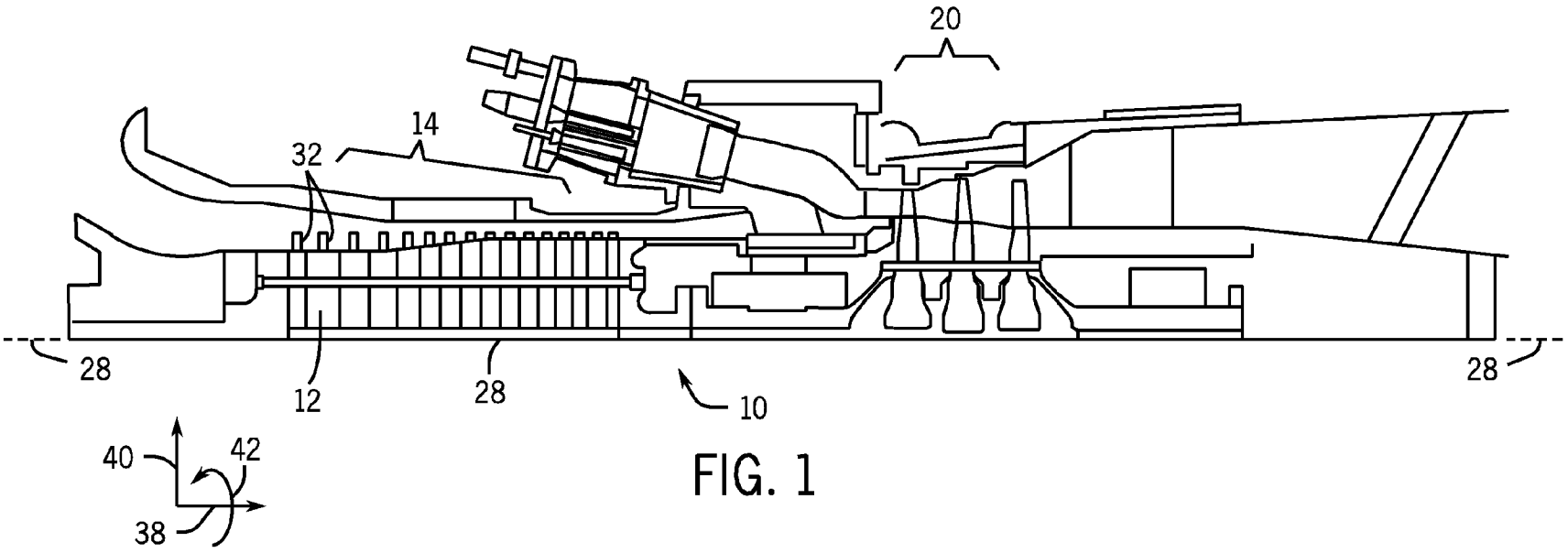
FIG. 1 is a cross-sectional side view of an embodiment of a turbomachine system (e.g., gas turbine system) including a compressor with a coupled disks rotor having a self-locking closure bucket assembly for each rotor disk or stage.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to turbomachines that include self-locking closure bucket assemblies. For example, the turbomachine may be a gas turbine engine, steam turbine engine, compressor, or any other type of rotary machine (e.g., turbomachine). The self-locking closure bucket assembly may be used to block circumferential movement of the other buckets (e.g., tangential entry dovetailed buckets) within a groove of a rotor disk or stage (e.g., same row or stage). In particular, the self-locking closure bucket assembly includes a closure bucket (e.g., rotary blade with a mounting base portion) and only a single wedge disposed within the same portion of the groove (e.g., closure groove portion) to secure the closure bucket within the closure groove. The closure groove portion includes a first groove surface, a second groove surface disposed opposite the first groove surface, and a third surface disposed between the first and second groove surfaces. The closure bucket includes a first surface (e.g., of a male dovetail portion having protrusions) that interfaces with the first groove surface (e.g., having recesses for the protrusions) and a second surface disposed opposite the first surface to contact or interface with the single wedge. The single wedge may be pre-inserted or disposed in the closure groove portion (e.g., against the third groove surface). The closure bucket assembly may include a non-loaded screw (e.g., threaded fastener) that extends along a longitudinal axis of the wedge through the wedge. The screw enables the wedge to be radially displaced from the third groove surface to a location in between the closure bucket and the closure groove portion. For example, the radially displaced wedge may interface or contact both the second surface of the closure bucket and the second groove surface of the closure groove. At operating conditions, along with centrifugal force, an axial force exerted on the single wedge against the second surface of the closure bucket (and second groove surface of the closure groove) secures the closure bucket within the closure groove. The self-locking closure bucket assembly enables the securing of the closure bucket within the closure groove without utilizing a locking screw that extends through the closure bucket (e.g., dovetail portion) into the rotor (e.g., rotor disk or stage). As a result, stress concentrations in the rotor due to a conventional locking screw may be avoided. In addition, the self-locking bucket assembly may enable reassembly of the stage or row without damaging or remachining the rotor (e.g., during maintenance of a turbine or compressor stage).

Turning now to the drawings, FIG. 1 illustrates an embodiment of a turbomachine system 10 (e.g., gas turbine system having an axial compressor 14 with coupled disk rotors) having a self-locking closure bucket assembly (e.g., bucket locking assembly) for each rotor disk or stage 12. The self-locking closure bucket assembly, described in greater detail below, utilizes the centrifugal moment to which the closure bucket is subject to as a consequence of its asymmetrical shape, to secure the closure bucket itself within a groove of the respective rotor disk or stage 12 and to block circumferential movement of the other buckets within the same row, stage, or groove. The function of the wedge is to react to an axial force which derives from the centrifugal moment of the closure bucket and to transmit axial force to the groove (e.g., downstream groove surface). The self-locking closure bucket assembly avoids the need for a locking screw disposed through a dovetail portion of the closure bucket and into the rotor disk or stage 12. Thus, the potential stress concentrations due to such a fixing screw may be avoided. Further, the self-locking closure bucket assembly enables reassembly of a stage without damaging or remachining the rotor disk or stage 12. The self-locking closure bucket assembly may be used in any turbomachine, such as, but not limited to, gas turbine engines, steam turbine engines, hydro turbines, compressors, or any other rotary machines.

Figure 9:
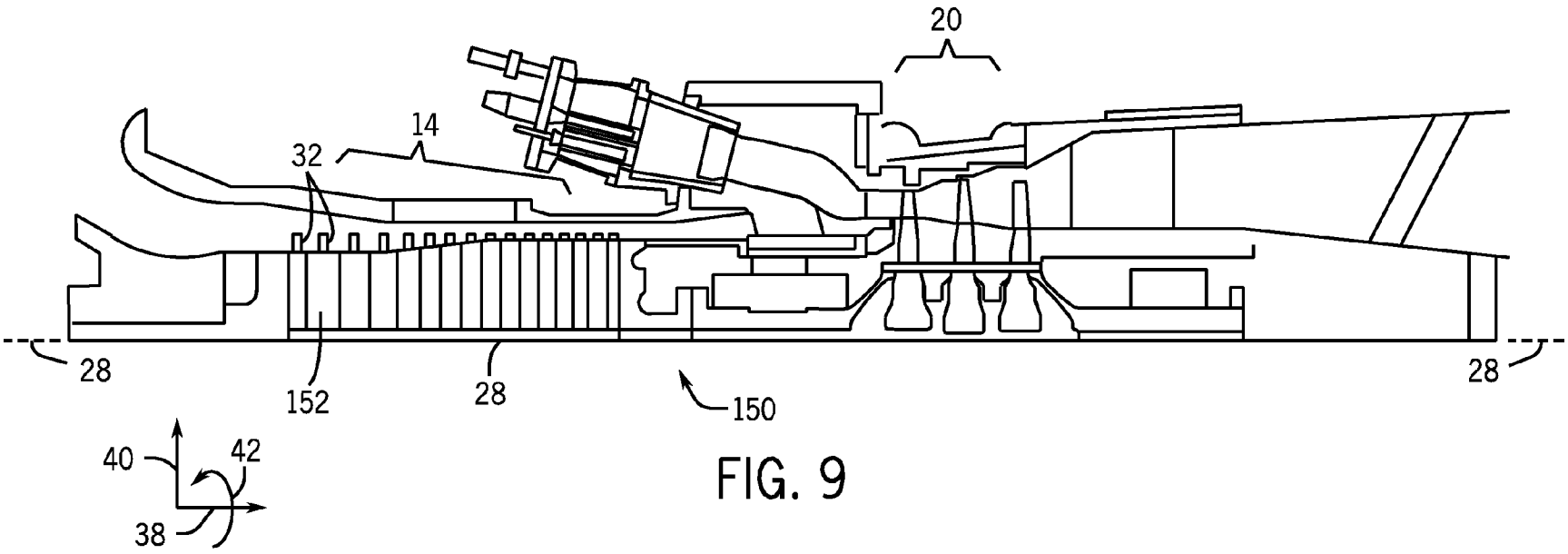
FIG. 9 is a cross-sectional side view of an embodiment of a turbomachine system (e.g., gas turbine system) including a compressor with a single piece rotor having the self-locking closure bucket assembly of FIG. 2 for each stage.
Figure 10:
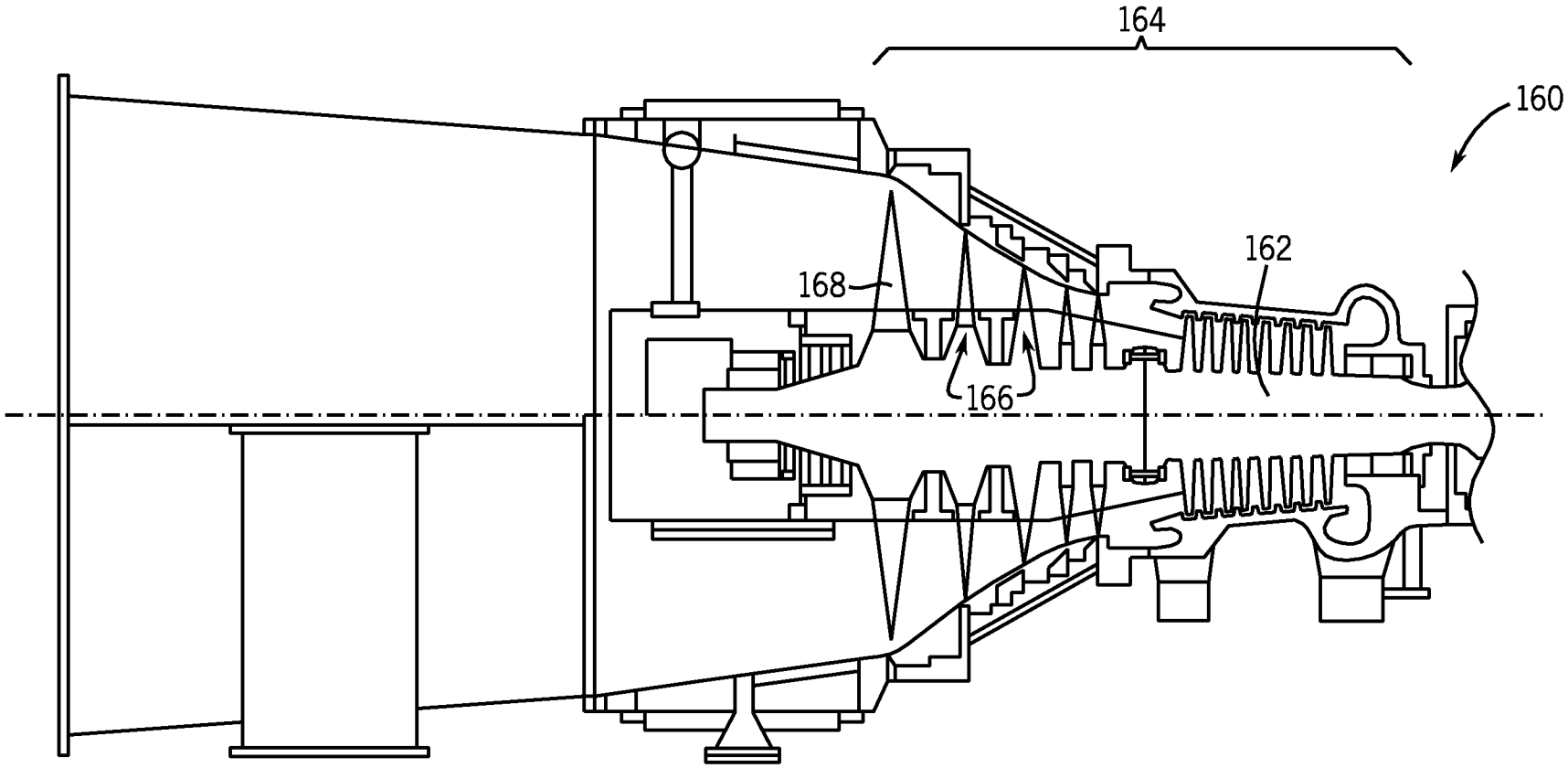
FIG. 10 is a partial cross-sectional side view of a turbomachine system (e.g., steam turbine system) including a turbine with a single piece rotor having the self-locking closure bucket assembly of FIG. 2 for each stage.

The system 10 includes a compressor 14 (e.g., rotary machine) and a turbine 20. In the illustrated embodiment, the compressor 14 includes compressor blades or buckets 32. The compressor buckets 32 within the compressor 14 are coupled to the rotor disk or stage 12 and rotate as the rotor disk or stage 12 of the compressor 14 (which form a shaft) are driven into rotation by the turbine 20. Besides the axial compressor 14 of the system 10 of FIG. 1, the self-locking closure bucket assembly may also be used in the axial compressor 14 of FIG. 9, which illustrates a gas turbine system 150 having the axial compressor 14 with a single piece rotor 152. Also, the self-locking closure bucket assembly may also be used in a steam turbine system 160 (e.g., axial exhaust steam turbine) having a single piece rotor 162 as illustrated in FIG. 10. The steam turbine system of FIG. 10 includes a turbine section 164 that includes multiple stages 166. Each stage 166 includes a plurality of blades 168 arranged in rows that extend circumferentially around a shaft 318. In the following discussion, reference may be made to various directions, such as an axial direction or axis 38, a radial direction or axis 40, and a circumferential direction or axis 42, relative to the rotational or longitudinal axis 28 of the system 10.

Figure 2:
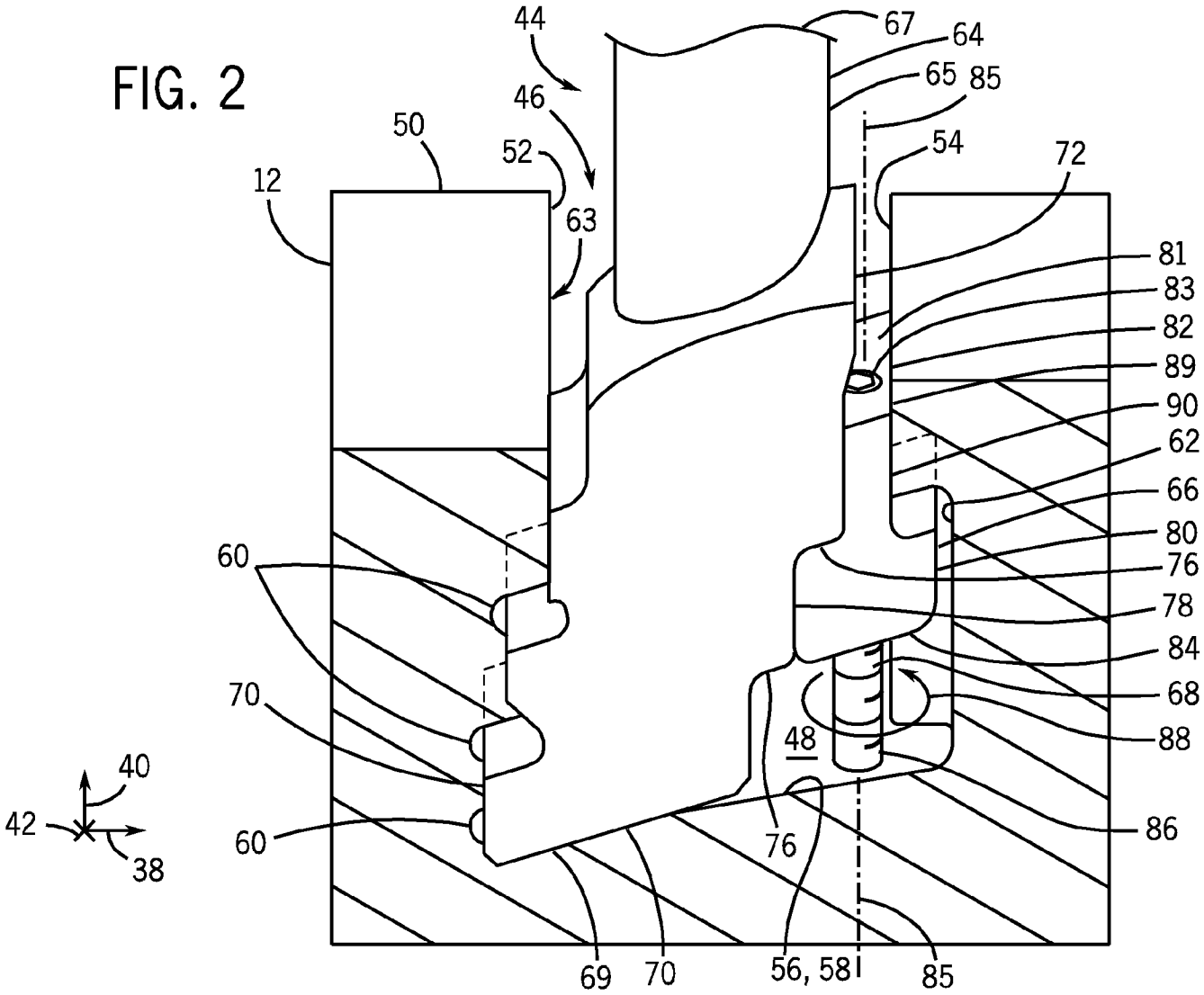
FIG. 2 is a partial side perspective view of an embodiment of a self-locking closure bucket assembly disposed within a groove of the rotor disk or stage.

FIG. 2 is a partial side perspective view of an embodiment of the self-locking closure bucket assembly 44 disposed within a groove 46 (e.g., closure groove portion 48) of the rotor disk or stage 12. The groove 46 runs in the circumferential direction 42 along a peripheral portion 50 disposed about the rotational axis 28 of the rotor disk or stage 12 (see FIG. 1). The groove 46 includes groove surfaces 52, 54, 56. Groove surface 52 is disposed opposite groove surface 54. Groove surface 56 is disposed at a base or bottom portion 58 of the groove 46 between groove surfaces 52, 54. Groove surface 52 of the closure groove 48 includes a plurality of recesses 60 (e.g., hooks) that extend axially 38 within the groove surface 52 (see FIG. 7). The number of recesses 60 may vary between 1 to 5 or more recesses 60. As depicted, the groove surface 52 includes two recesses 60. Groove surface 54 of the closure groove 48 includes a single recess 62 that extends axially 38 within the groove surface 54 (see FIG. 7). Together, the groove surfaces 52, 54 form an axial platform 63 that interfaces with the closure bucket assembly 44 to secure the assembly 44 within the closure groove 48. As described in greater detail below, a cross-sectional area of the closure groove 48 is greater than a cross-sectional area of the groove portion for the other buckets.

The closure bucket assembly 44 includes a bucket 64 (e.g., closure bucket 64), single wedge 66, and a threaded fastener or screw 68 (e.g., unloaded fixing screw) disposed within the same closure groove portion 48 (as opposed to axially adjacent groove portions extending in the circumferential direction 42). The bucket 64 includes an upper portion 65 (e.g., blade or airfoil 67) and a lower portion 69 (e.g., mounting portion or male dovetail configuration 70). The lower portion 69 includes surface 71 (e.g., upstream surface) and surface 72 (e.g., downstream surface). The surface 71 includes a plurality of protrusions 74 (e.g., axial projections or hooks) that extend axially 38 from the surface 71. The number of protrusions 74 may vary between 1 to 5 or more protrusions 74. As depicted, the groove surface 52 includes three protrusions 74. At least some of the protrusions 74 are configured to fit within the recesses 60 of the groove surface 52 to block movement of the closure bucket 64 in the radial direction 40, while other protrusions 74 may abut the groove surface 52 without interacting with the recesses 60. The surface 72 includes a plurality of recesses 76 that extend axially into the surface 72. One of the recesses 76 interacts with the single wedge 66. The closure bucket 64 is configured to be radially 40 inserted and then through a series of axial 38 and radial 40 displacements the bucket 64 is positioned within the closure groove 48 to block circumferential movement 42 of other buckets within the groove 46 relative to the rotor disk or stage 12.

The single wedge 66 includes wedge surfaces 78, 80, 82, 84. The wedge surface 78 is disposed opposite wedge surface 80, while wedge surface 82 (e.g., top surface) is disposed opposite wedge surface 84 (e.g., bottom surface). Wedges surfaces 78, 80 extend between wedges surfaces 82 and 84. The screw 68 extends along a longitudinal axis 85 of the wedge 66 through the wedge 66. The screw 68 is configured to radially 40 displace the wedge 66 via rotation 88 of the screw 68 about the longitudinal axis 85. In addition, the screw 68 is only needed to avoid the wedge 66 losing operative position when the rotor disk or stage 12 is not rotating. The screw 68 is unloaded (i.e., no forces are exerted against the screw 68). Thus, during the rotation 88 of the screw 68, the screw 58 is free of stress. In certain embodiments, the screw 68 may include a hexagonal socket 81 (or any other suitable tool interface) located at a top end 83 of the screw 68 to enable a tool (e.g., hex key) to rotate the screw 68 to move the wedge 66 up and/or down the screws 68. The wedge 66 is configured to be inserted within the closure groove portion 48, prior to the closure bucket 64, with surface 84 contacting groove surface 56 and the wedge 66 located on a bottom portion 86 of the screw 68 (see FIG. 8). Upon rotation 88 of the screw 68, the wedge 66 is radially displaced to a top portion 89 of the screw 68 until wedge surface 78 contacts or interfaces with surface 72 (e.g., one of the recesses 68) of the closure bucket 64 and wedge surface 80 contacts or interfaces with groove surface 54 (e.g., recess 62) as depicted in FIG. 2. Both surfaces 54, 72 block further radial movement 40 of the wedge 66. When radially 40 displaced to contact surface 54, 72, the wedge 66 includes an upper portion 90 disposed between and contacting both the bucket 64 and the groove surface 54. In this position at operating conditions, the upper portion 90 is subject to an axial force (due to the centrifugal moment of the closure bucket) against the groove surface 54. In conjunction with centrifugal force exerted on the bucket 64 during circumferential 42 rotation of the rotor disk or stage 12 and bucket 64, the axial force exerted on the wedge 66 secures the closure bucket 64 within the closure groove 48. This avoids the use of a locking screw disposed through the bucket 64 into the rotor 12 and any associated stress concentration in the rotor 12. In addition, the stage of buckets may be reassembled without damaging or remachining the rotor 12.

In certain embodiments, the material of the wedge 66 may include a different thermal expansion coefficient than the closure bucket 64. For example, the wedge 66 may include a higher thermal expansion coefficient than the closure bucket 64. The higher thermal expansion coefficient of the wedge 66 may enable the wedge 66 (while also giving the wedge 66 a higher friction) to expand more during operation of the turbomachine system 10 to exert an even greater axial 38 force against both the bucket 64 and the closure groove 48. In some embodiments, the wedge 66 and/or the closure bucket 64 may be frozen (e.g., in liquid nitrogen) prior to assembly of the closure bucket assembly 44 to temporarily shrink the wedge 66 and/or bucket 64 to enable a better interference fit once the wedge 66 and/or bucket 64 warm up and expand.

Figure 3:
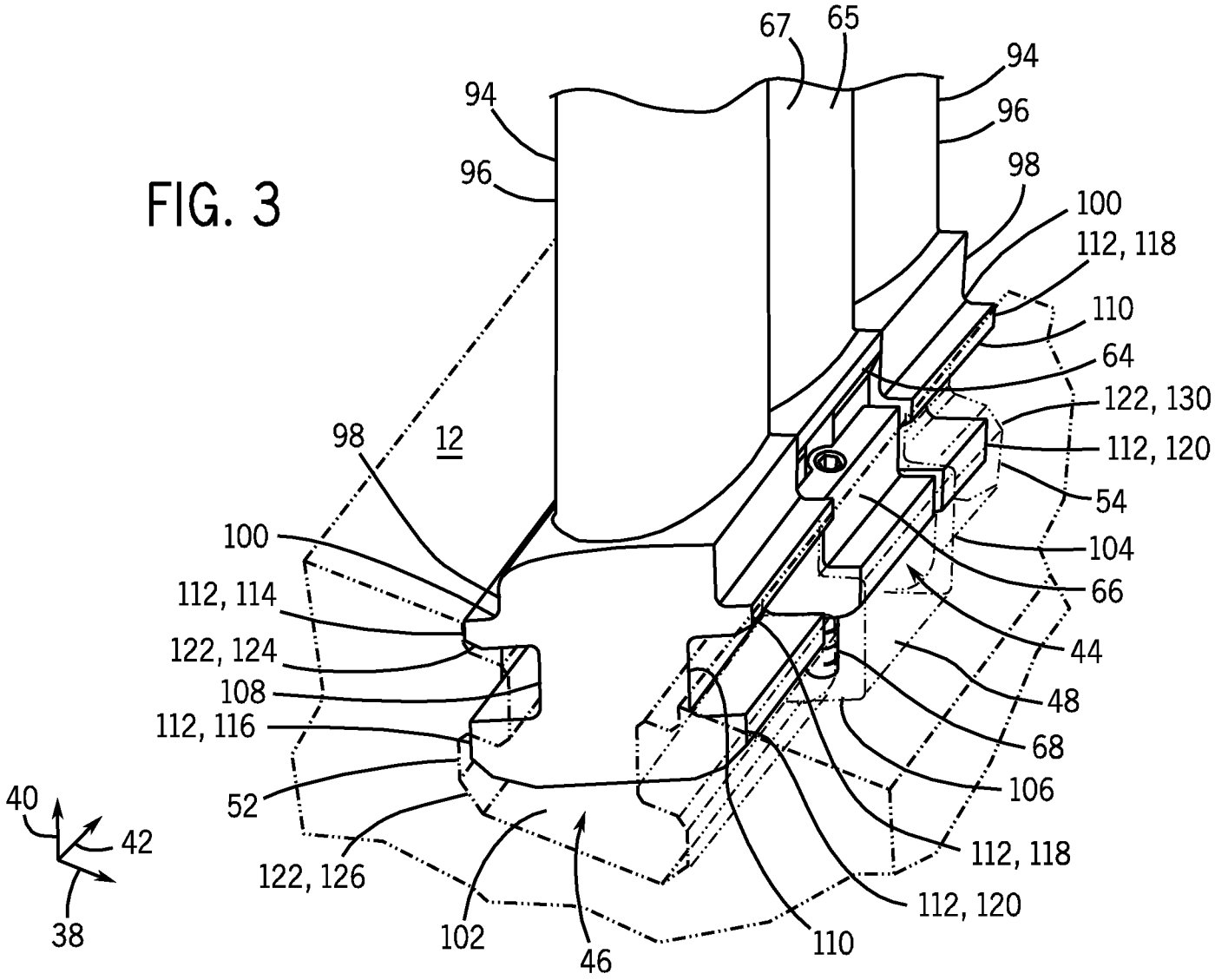
FIG. 3 is partial rear perspective view of an embodiment of the self-locking closure bucket assembly of FIG. 2 disposed within the groove of the rotor disk or stage between adjacent buckets.
Figure 4:
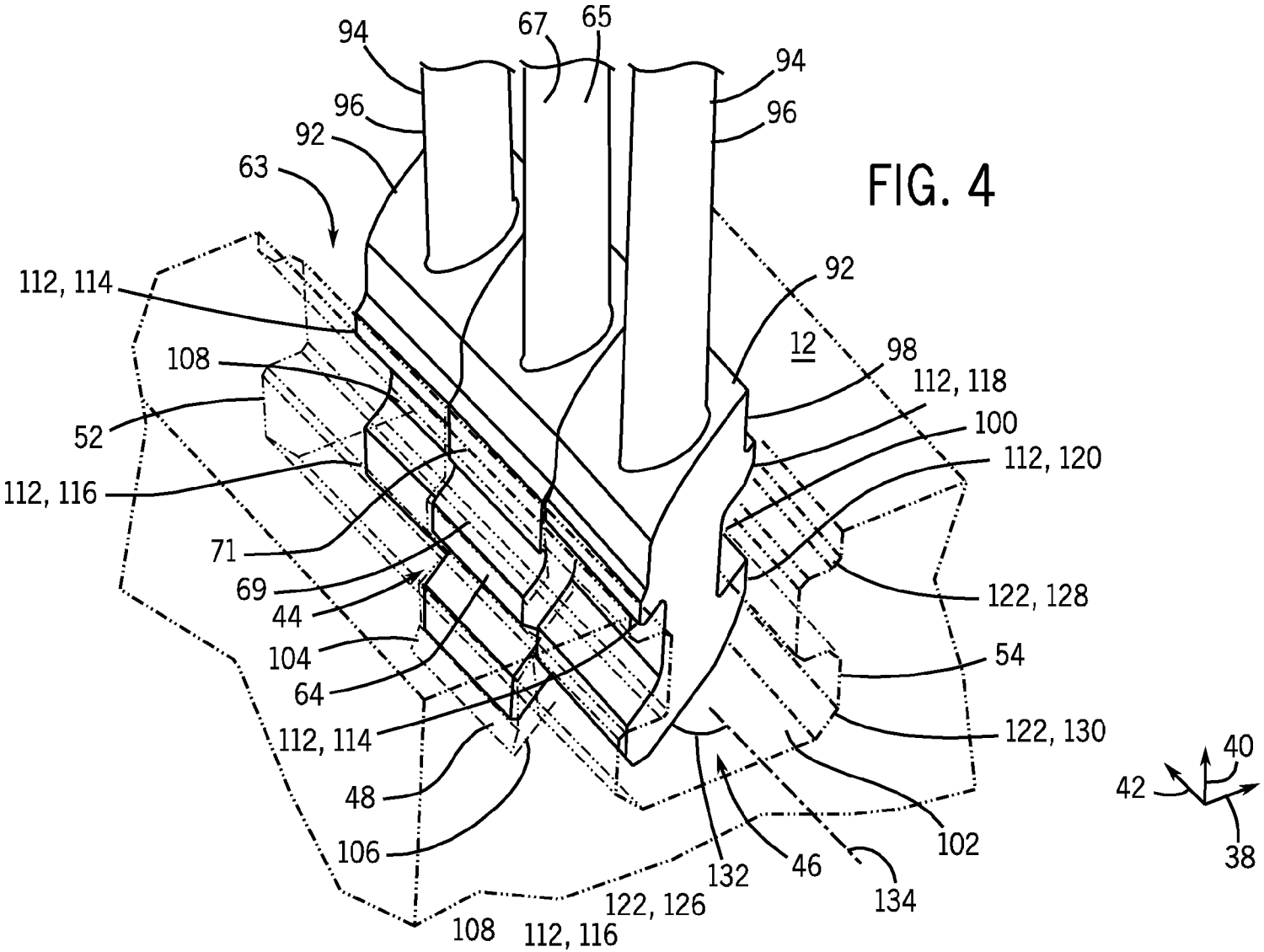
FIG. 4 is partial front perspective view of an embodiment of the self-locking closure bucket assembly of FIG. 2 disposed within the groove of the rotor disk or stage between the adjacent buckets.

FIGS. 3 and 4 are partial rear (e.g., downstream) and front (e.g., upstream) perspective views of an embodiment of the self-locking closure bucket assembly 44 of FIG. 2 disposed within the groove 46 of the rotor disk or stage 12 between adjacent buckets 92. As depicted, the closure bucket 64 abuts against the adjacent buckets 92 blocking the circumferential movement 42 of the buckets 92 relative to the rotor disk or stage 12. The adjacent buckets 92 include tangential entry dovetail buckets. Similar to the closure bucket 64, the buckets 92 each include an upper portion 94 (e.g., rotary blade or airfoil 96) and lower portion 98 (e.g., mounting portion or male dovetail configuration 100). The lower portion 98 is configured to be inserted within or removed from the closure groove 48 of the groove 12 before tangential entry or removal into groove portion 102 of the groove 12. Groove portion 102 extends circumferentially 42 along the groove 12 from one side 104 of closure groove portion 48 to the other side 106 of closure groove portion 48. The groove portion 102 includes the groove surfaces 52, 54. Closure groove portion 48 has a larger cross-sectional area than a cross-sectional area of groove portion 102 (see FIGS. 6 and 7). The smaller cross-sectional area of groove portion 102 (as well as arrangement) blocks circumferential 42 movement of the closure bucket 64 from the closure groove portion 48 to the groove portion 102.

The lower portion 98 of each bucket 92 includes surface 108 (e.g., upstream surface) and surface 110 (e.g., downstream surface). Similar to the closure bucket 64, the lower portion 98 of each bucket 92 includes protrusions 112 (e.g., axial projections) that extend axially 38 outward from both surfaces 108, 110. The number of protrusions 112 extending from each surface 108, 110 may vary from 1 to 5 or more. As depicted, surface 108 of each bucket 92 includes an upper axial projection 114 and a lower axial projection 116, while surface 110 of each bucket 92 also includes an upper axial projection 118 and a lower axial projection 120. The groove portion 102 includes a plurality of recesses 122 for receiving the protrusions 112 of the buckets 92. For example, groove surface 52 of the groove portion 102 includes recesses 124, 126 and groove surface 54 of the groove portion 102 includes recesses 128, 130. The recesses 124, 126, 128, 130 receive axial projections 114, 116, 118, 120, respectively. Together, the groove surfaces 52, 54 form the axial platform 63 that interfaces with and secures each bucket 92 within the groove portion 102. For example, the disposition of the lower axial projections 116, 120 within the recesses 116, 120 blocks the radial movement 40 of each bucket 92.

As depicted, the lower portion 69 of the closure bucket 64 and the wedge 66 are disposed at an angle 132 relative to a centerline 134 of the groove 46 that extends circumferentially 42 about the rotor disk or stage 12 (see FIG. 5, a top view of the self-locking closure bucket assembly 44 in the closure groove 48) within the closure groove portion 48. The lower portions 69, 98 of the respective buckets 64, 92 are disposed at the same angle 132 relative to the centerline 134. The angle 132 may range from approximately 0 to 60 degrees, 0 to 30 degrees, 30 to 60 degrees, 15 to 45 degrees, and all subranges therebetween. For example, the angle 132 may be approximately 0, 5, 10, 15, 20, 25, 30, 35, 40, 45, 50, 55, or 60 degrees, or any other angle.

Figure 5:
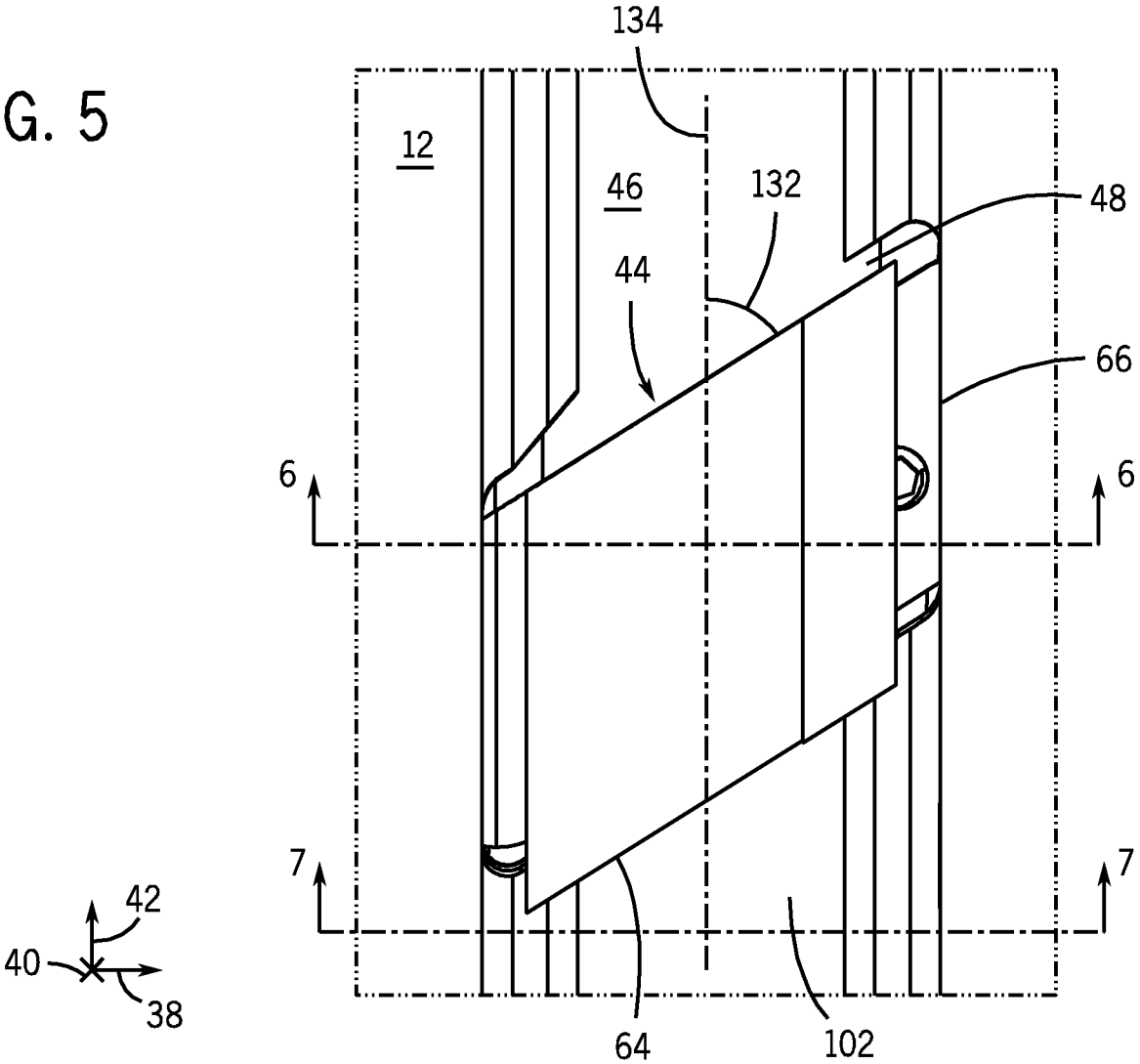
FIG. 5 is a top view of an embodiment of the self-locking closure bucket assembly of FIG. 2 disposed within the groove of the rotor disk or stage.
Figure 7:
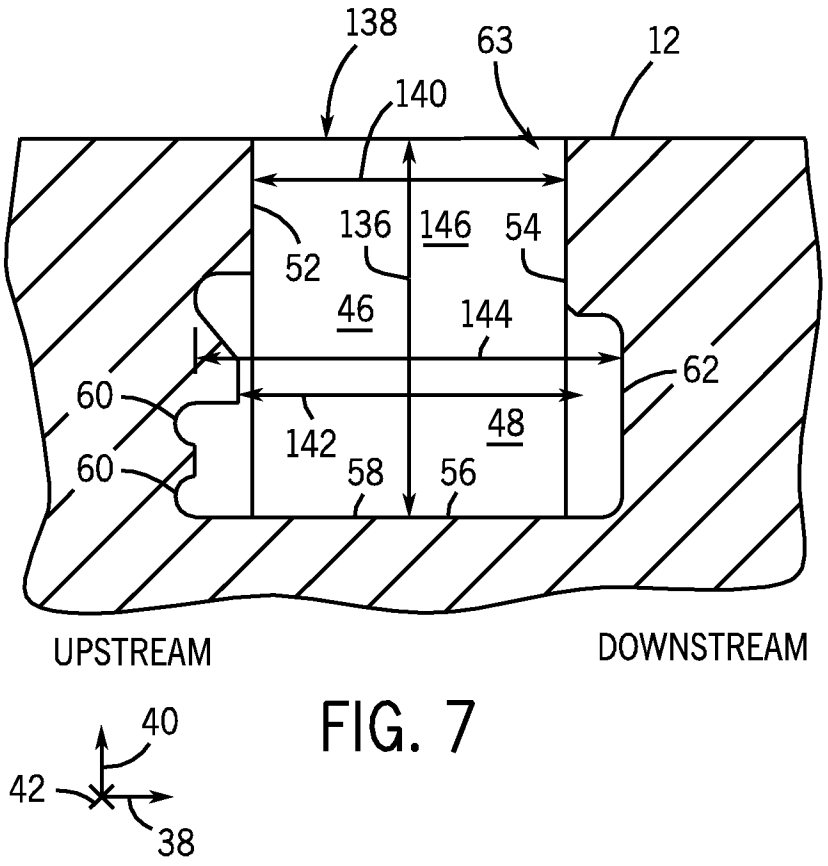
FIG. 7 is a cross-sectional side view of an embodiment of a closure groove portion for the self-locking closure bucket assembly taken along line 7-7 of FIG. 5.
Figure 6:
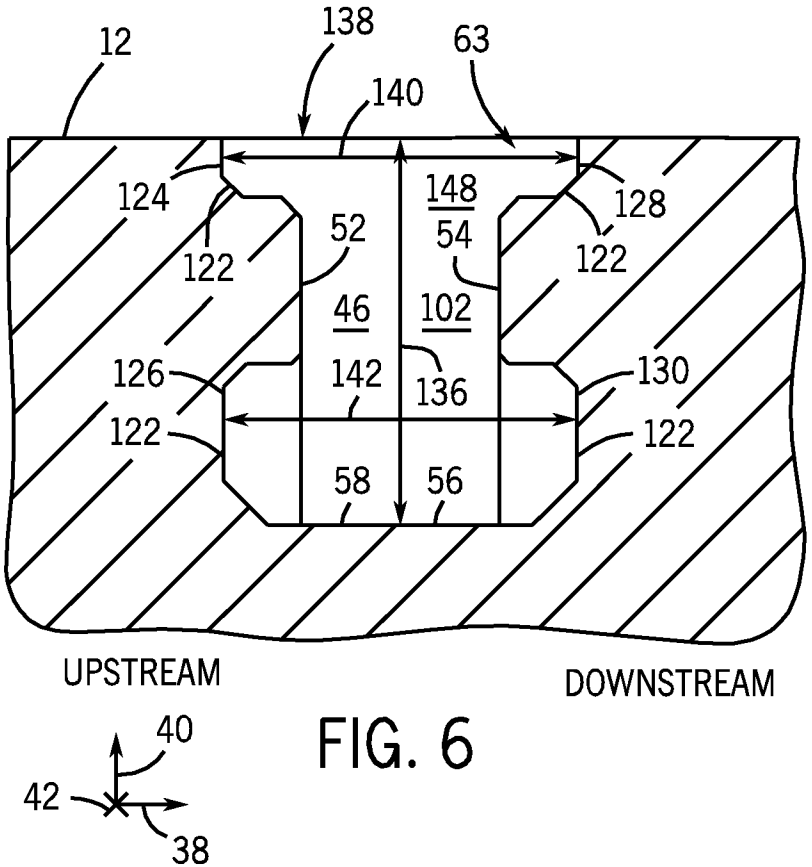
FIG. 6 is a cross-sectional side view of an embodiment of a groove portion for buckets taken along line 6-6 of FIG. 5.

FIG. 6 is cross-sectional side view of an embodiment of the groove portion 102 for the buckets 92 taken along line 6-6 of FIG. 5, while FIG. 7 is a cross-sectional side view of an embodiment of the closure groove portion 48 for the self-locking closure bucket assembly 44 taken along line 7-7 of FIG. 5. The closure groove portion 48 and the groove portion 102 are as described above in FIGS. 2-5. In addition, a depth or height 136 of each groove portion 48, 102 are the same from a top portion 138 of the groove portions 48, 102 to the bottom portion 58. As shown in FIG. 6, the groove portion 102 includes a width 140 between the surfaces 52, 54 at the recesses 124, 128 and a width 142 between the surfaces 52, 54 at the recesses 126, 130. The width 140 is greater than the width 142. As shown in FIG. 7, the closure groove portion 48 includes the same width 140 between the surfaces 52, 54 above the recesses 60, 62 adjacent the top portion 138. In certain embodiments, the width 140 may vary. The closure groove portion 48 includes a width 144 between the surfaces 52, 54 beginning with the upper recess 60 of surface 52 and ending with the bottom portion 58. The width 142 of the groove portion 102 is depicted within the closure groove portion 48. As illustrated, the width 144 of the closure groove portion 48 from the upper recess 60 to the bottom portion 58 is greater than the width 142 of the groove portion 102. In addition, as mentioned above, the closure groove portion 48 has a larger cross-sectional area 146 than a cross-sectional area 148 of groove portion 102. The smaller cross-sectional area 148 of groove portion 102 (as well as arrangement) blocks circumferential 42 movement of the closure bucket 64 from the closure groove portion 48 to the groove portion 102. In addition, the larger cross-sectional area 146 of the closure groove portion 48 enables the tangential entry and removal of the buckets 92 from the groove portion 102 to the closure groove portion 48.

Figure 8B:
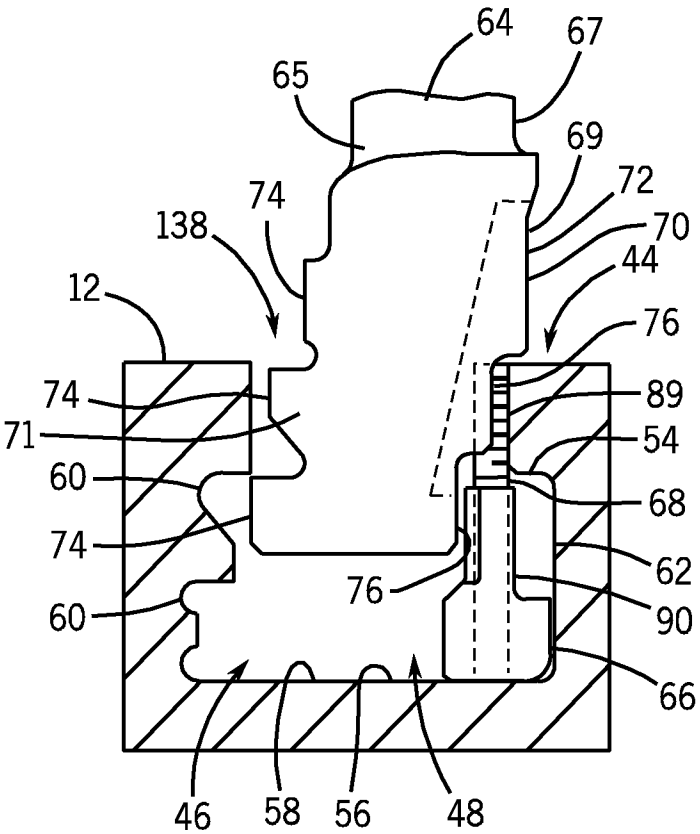
FIGS. 8A-F are a series of partial side views illustrating the assembly of the self-locking closure bucket assembly of FIG. 2 within the closure groove portion in accordance with an embodiment.
Figure 8A:
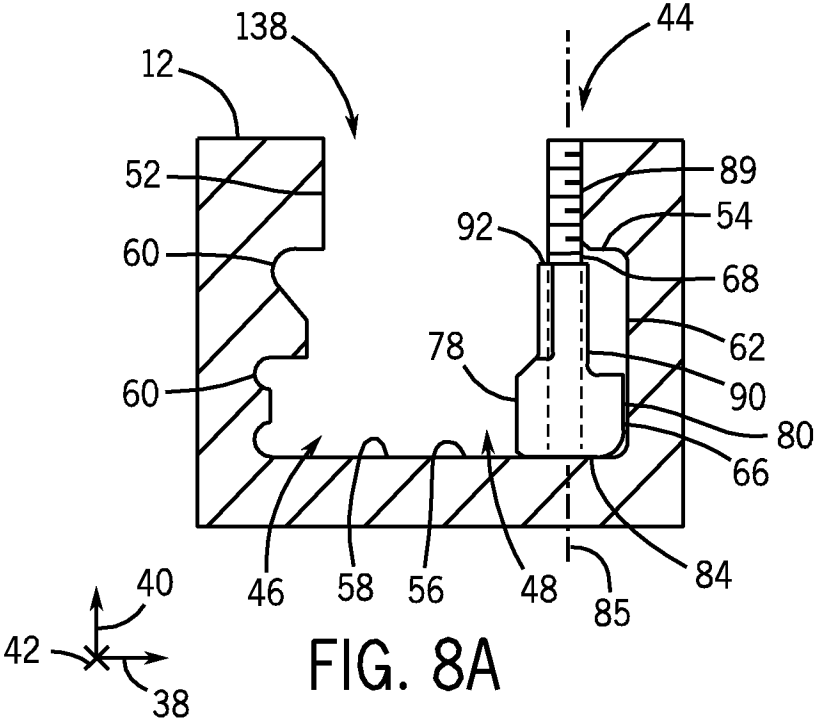
Figure 8D:
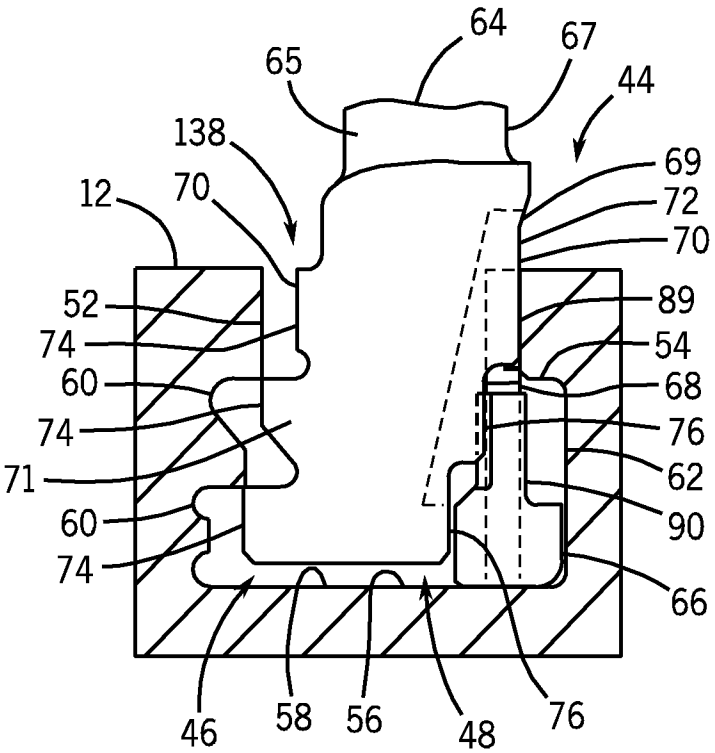
Figure 8C:
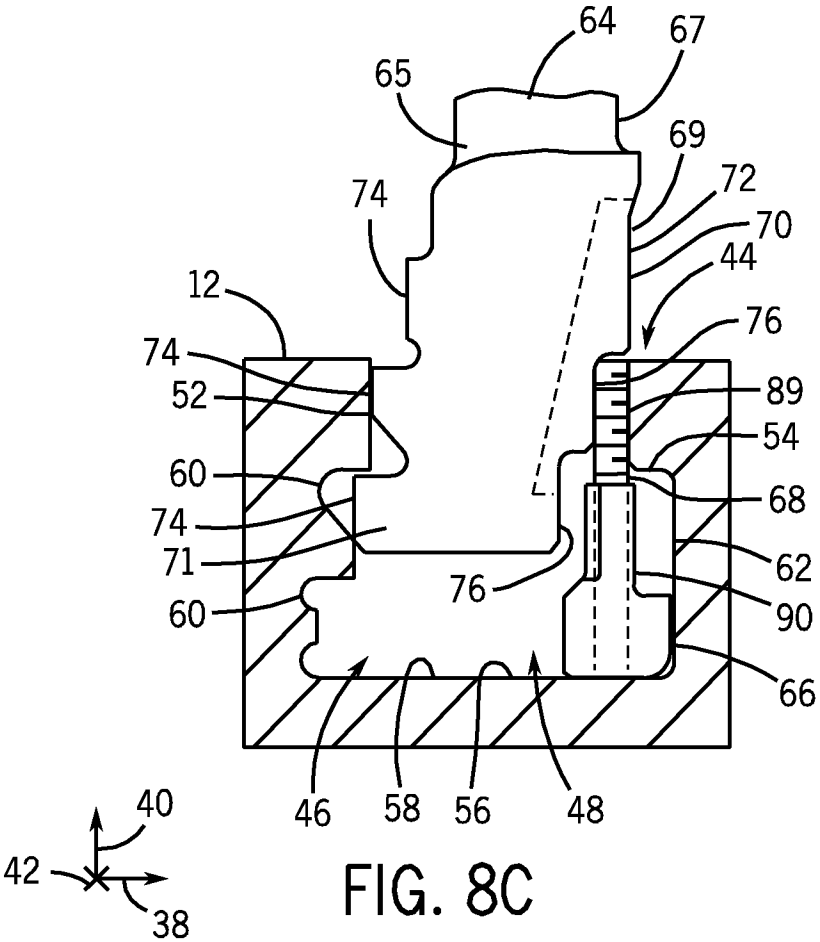
Figure 8F:
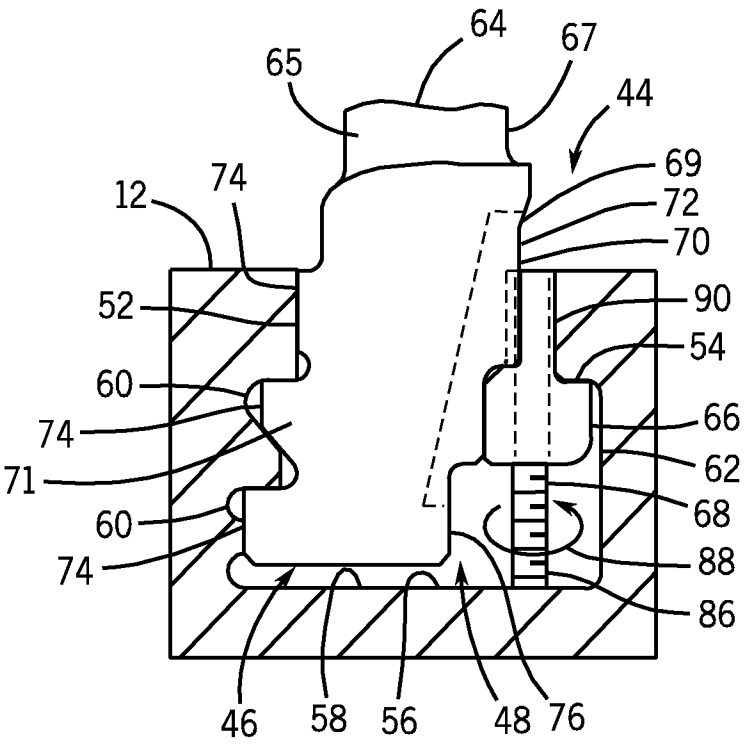
Figure 8E:
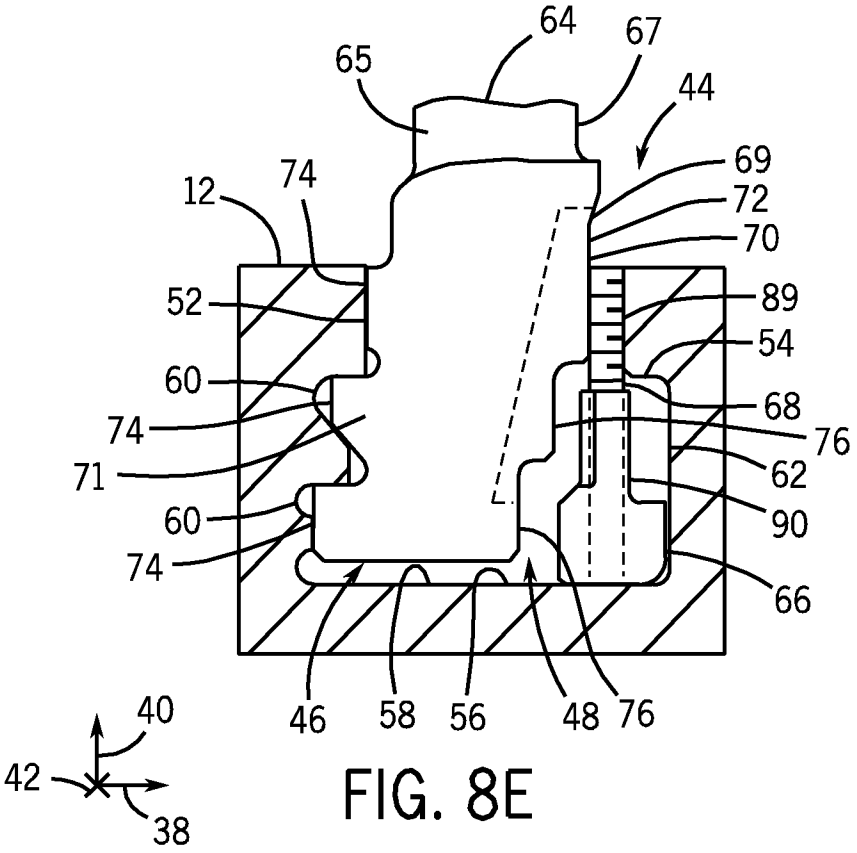

FIGS. 8A-F are a series of partial side views illustrating the assembly of the self-locking closure bucket assembly 44 of FIG. 2 within the closure groove portion 48 of the rotor disk or stage 12. The closure bucket assembly 44 and the closure groove portion 48 are as described above. As depicted in FIG. 8A, the wedge 66 is inserted within the closure groove portion 48, prior to the closure bucket 64, with surface 84 contacting groove surface 56 within recess 62 and the wedge 66 located on a bottom portion 86 of the screw 68. In FIG. 8B, the closure bucket 64 is inserted radially 40 into the closure groove portion 48 until the surface 72 (e.g., upper recess 76) contacts or abuts the rotor disk or stage 14. In FIG. 8C, the closure bucket 64 is axially 38 displaced or shifted until surface 71 (e.g., middle protrusion 74) contacts or abuts the groove surface 52. In FIG. 8D, the closure bucket 64 is radially 40 displaced or shifted until the protrusions 74 (e.g., middle and bottom protrusions 74) are aligned with the respective recesses 60 within the groove surface 52. In FIG. 8E, the closure bucket 64 is axially 38 displaced or shifted until the protrusions 74 (e.g., middle and bottom protrusions 74) contact the groove surface 52 and are disposed within the respective recesses 60. In FIG. 8F, the screw 68 is rotated 88 (e.g., via a tool such as hex key) about the longitudinal axis 85 to radially 40 displace the top portion 89 of the wedge 66 until the wedge surface 78 contacts or interfaces with surface 72 (e.g., one of the recesses 68) of the closure bucket 64 and wedge surface 80 contacts or interfaces with groove surface 54 (e.g., recess 62). Both surfaces 54, 72 block further radial movement 40 of the wedge 66. In this position at operating conditions, the upper portion 90 of the wedge 66 is subject to an axial force (due to the centrifugal moment of the closure bucket) against the groove surface 54. In conjunction with centrifugal force exerted on the bucket 64 during circumferential 42 rotation of the rotor disk or stage 14 and bucket 64, the axial force exerted on the wedge 66 secures the closure bucket 64 within the closure groove 48. This avoids the use of a locking screw disposed through the bucket 64 into the rotor 12 and any associated stress concentration in the rotor 12. In addition, the stage of buckets may be reassembled without damaging or remachining the rotor 12. The disassembly of the closure bucket assembly 44 may occur via performing some or all of the steps above in reverse order.

Also, as mentioned above, the wedge 66 may include a higher thermal expansion coefficient than the closure bucket 64. Further, in some embodiments, the wedge 66 and/or the closure bucket 64 may be frozen (e.g., in liquid nitrogen) prior to assembly of the closure bucket assembly 44 to temporarily shrink the wedge 66 and/or bucket 64 to enable a better interference fit once the wedge 66 and/or bucket 64 warm up and expand.

Technical effects of the disclosed embodiments include providing a self-locking closure bucket assembly 44 to block circumferential movement of buckets 92 within the same groove 42 (e.g., row or stage) of the rotor disk or stage 14. In particular, the self-locking closure bucket assembly 44 includes the closure bucket 64, the single wedge 66, and the screw 68 (e.g., unloaded fixing screw) configured to be disposed within the same closure groove portion 48. Upon radial 40 displacement of the wedge 66 (e.g., via the screw 68) between surface 72 of the closure bucket 64 and the groove surface 54, the wedge 66 axially 38 exerts force against both the bucket 64 (e.g., surface 72) and the rotor surface 54. In this position at operating conditions, the upper portion 90 of the wedge 66 is subject to an axial force (due to the centrifugal moment of the closure bucket) against the groove surface 54. This avoids the use of a locking screw disposed through the bucket 64 into the rotor 12 and any associated stress concentrations in the rotor 12. In addition, the stage of buckets may be reassembled without damaging or remachining the rotor 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbomachine, comprising:

at least one rotor disk or stage comprising a peripheral portion disposed about a rotational axis of the at least one rotor disk or stage, wherein the peripheral portion comprises a groove that extends circumferentially about the peripheral portion, wherein the groove has a first groove surface and a second groove surface disposed opposite the first groove surface;

at least one bucket disposed within the groove;

a closure bucket disposed adjacent the at least one bucket within the groove, wherein the closure bucket has a first surface that interfaces with the first groove surface and a second surface disposed opposite the first surface, and the closure bucket blocks circumferential movement of the at least one bucket within the groove relative to the at least one rotor disk or stage;

a single wedge disposed between and contacting the second surface of the closure bucket and the second groove surface to secure the closure bucket within the groove, wherein the single wedge is configured to be disposed within the groove prior to the closure bucket, and wherein the closure bucket and the single wedge are configured to both be disposed within a same portion of the groove; and an unloaded threaded fastener that extends along a longitudinal axis through the single wedge to enable the single wedge to move radially to interface with the second surface of the closure bucket and the second groove surface to secure the closure bucket within the groove.

2. The system of claim 1, wherein the groove comprises a first portion having a first cross-sectional area at a first circumferential location about the peripheral portion and a second portion having a second cross-sectional area greater than the first cross-sectional area at a second circumferential location about the peripheral portion different from the first circumferential location.

3. The system of claim 2, wherein the at least one bucket is configured for tangential entry into and tangential removal from the first portion via the second portion of the groove.

4. The system of claim 2, wherein the closure bucket and the single wedge are both disposed within the second portion of the groove.

5. The system of claim 1, wherein the groove comprises a third groove surface disposed between the first and second groove surfaces, and the single wedge is configured to move radially from the third groove surface to interface with the second surface of the closure bucket and the second groove surface to secure the closure bucket within the second portion of the groove.

6. The system of claim 1, wherein the unloaded threaded fastener is configured to rotate to radially move the single wedge.

7. The system of claim 1, wherein the single wedge is configured to receive an axial force and to transfer the axial force to the second groove surface.

8. The system of claim 1, wherein the single wedge comprises a higher thermal expansion coefficient than the closure bucket.

9. The system of claim 1, wherein the closure bucket comprises a male dovetail region configured to be inserted the groove.

10. The system of claim 1, wherein the turbomachine comprises a compressor, turbine, or a combination thereof.

11. A system, comprising:

a bucket locking assembly for securing a plurality of buckets within a groove of a rotor disk or stage of a turbomachine to block circumfential movement of the plurality of buckets relative to the rotor disk or stage, wherein the bucket locking assembly comprises:

a closure bucket configured to be disposed between adjacent buckets within the groove, wherein the closure bucket has a first surface configured to interface with a first groove surface of the groove and a second surface disposed opposite the first surface, and the closure bucket is configured to block circumferential movement of the plurality of buckets within the groove relative to the rotor disk or stage;

a single wedge configured to be disposed between and to contact the second surface of the closure bucket and a second groove surface of the groove to secure the closure bucket within the groove, wherein the single wedge is subject to axial force on the second surface of the closure bucket to secure the closure bucket within the groove, and wherein the single wedge is configured to be disposed within the groove prior to the closure bucket, and the closure bucket and the single wedge are configured to both be disposed within a same portion of the groove; and an unloaded threaded fastener that extends along a longitudinal axis through the single wedge to enable the single wedge to move radially to interface with the second surface of the closure bucket and the second groove surface to secure the closure bucket within the groove.

12. The system of claim 11, wherein the single wedge is configured to be disposed within the groove prior to the closure bucket.

13. The system of claim 11, wherein the closure bucket comprises a male dovetail region having a plurality of protrusions extending from the first surface, wherein the protrusions are configured to interact with recesses on the first groove surface of the groove to block radial movement of the closure bucket.

14. A method for securing buckets within a groove of a rotor disk or stage of a turbomachine, comprising:

disposing a single wedge into a closure groove portion of the groove, wherein the closure groove portion includes a first groove surface, a second groove surface disposed opposite the first groove surface, and a third groove surface disposed between the first and second groove surfaces and extending from the first groove surface to the second groove surface, the single wedge is disposed between first and second groove surfaces and against the third groove surface disposed between the first and second groove surfaces, the first groove surface includes a plurality of recesses, and the single wedge includes a first wedge surface and a second wedge surface;

subsequent to disposing the single wedge into the closure groove portion, radially inserting a closure bucket having a first surface and a second surface disposed opposite the second surface into the closure groove portion so that the second surface contacts an outer surface of the rotor adjacent the closure groove, wherein the closure bucket includes a plurality of protrusions that extend from the first surface;

axially displacing the closure bucket until the first surface contacts the first groove surface;

radially displacing the closure bucket until the plurality of protrusions align with the plurality of recesses of the first groove surface;

axially displacing the closure bucket until the first surface interfaces with the first groove surface and the plurality of protrusions insert into the plurality of recesses; and radially displacing the single wedge away from the third groove surface so that the single wedge does not directly contact the third groove surface and until the first wedge surface directly contacts the second surface of the closure bucket and the second wedge surface directly contacts the second groove surface to secure the closure bucket within the closure groove portion to block circumferential movement of the buckets relative to the rotor disk or stage.

15. The method of claim 14, wherein the wedge comprises an unloaded threaded fastener disposed through the single wedge along a longitudinal axis of the wedge, and radially displacing the single wedge comprises rotating the unloaded threaded fastener to radialy displace the single wedge away from the third groove surface so that the single wedge does not directly contact the third groove surface and until the first wedge surface directly contacts the second second surface of the closure bucket and the second wedge surface direclty contacts the second groove surface.

16. The method of claim 14, comprising radially inserting at least one bucket into the closure groove portion and then tangentially displacing the at least one bucket into another groove portion of the groove, wherein the another groove portion has a smaller cross-sectional area than a cross-sectional area of the closure groove portion.

* * * * *